United States Patent [19]

Brisciano

[11] Patent Number: 4,583,741

[45] Date of Patent: Apr. 22, 1986

[54] CHAMPIONSHIP TRACK AND FIELD GAME

[76] Inventor: Andrew Brisciano, 25 Sunset La., Miller Place, N.Y. 11764

[21] Appl. No.: 671,620

[22] Filed: Nov. 15, 1984

[51] Int. Cl.[4] ..... A63F 3/00

[52] U.S. Cl. ..... 273/244; 273/289

[58] Field of Search ..... 273/244, 248, 246, 259, 273/277, 243, 249, 258

[56] References Cited

U.S. PATENT DOCUMENTS 4,432,553 2/1984 Moore ..... 273/244

FOREIGN PATENT DOCUMENTS 1814111 6/1970 Fed. Rep. of Germany ..... 273/244
2556570 6/1977 Fed. Rep. of Germany ..... 273/244
986877 4/1951 France ..... 273/244
1275511 10/1961 France ..... 273/244
764210 12/1956 United Kingdom ..... 273/244
1384848 2/1975 United Kingdom ..... 273/244

*Primary Examiner*—Richard C. Pinkham
*Assistant Examiner*—Matthew L. Schneider
*Attorney, Agent, or Firm*—Leonard Belkin

[57] ABSTRACT

Game apparatus including a game board, board pieces, a pair of dice, and a separate board on which is located a winners circle. The game board contains a generally oval shaped race track with separate lanes for several players, with starting and finishing lines for several running events. Within the space bounded by the track are areas designated for a variety of other events including pole vault, board jump, high jump, and shot put. The winner of each event is moved into the winners circle and the team (player) with the most pieces in the circle when the events are completed is the winner of the game.

5 Claims, 5 Drawing Figures

CHAMPIONSHIP TRACK AND FIELD GAME

BACKGROUND OF THE INVENTION

This invention relates to game apparatus and more particularly to game apparatus for simulating a variety of competitive sporting events and utilizing a winners circle to determine the track and field champion.

A number of board games exist which play out a variety of competitive sporting events using two or more players who compete to become the winner of the game.

In U.S. Pat. No. 3,997,167 to Kratzer, there is shown a game board on which is imprinted a track and a mounted pair of spinners for different events. The spinners are employed to advance the players and a score box is employed to enter the score for each player in each event, the highest total score determining the winner.

In U.S. Pat. No. 4,141,560 to Kaslow, there is employed a game board displaying a variety of sporting events such as track for running and bicycling, boat rowing, swimming, baseball, and others. In this patent, game pieces are employed to move along the spaces in each event as determined by throws of a pair of dice. In some events, charts are employed to convert dice readings to scores, and in other events it is necessary to keep track of the number of throws necessary to complete the course and a factor is employed to convert the number of throws into time. Points are awarded for each event and the player with the largest total of points is the winner.

U.S. Pat. No. 4,241,924 to Arcara discloses a board game for simulating certain olympic athletic events utilizing a pair of dice for selecting cards from sets associated with each event. Each card identifies a particular event and specifies a particular playing condition and a point achievement score which could be a penalty. Scoring sheets are employed to tabulate the scores and determine the winning player.

U.S. Pat. No. 4,346,899 to Neubling, Sr. is directed to a board game featuring several competitive sports in track and field and comprises a board with spinner, two piece magnetic playing pieces, five sets of playing cards, and a die. The board is provided with a principal course and several secondary courses. The playing pieces are separated for use on the principal and secondary courses. One way of playing the game is to establish a point score for which the first player to reach becomes the winner.

In some of the board games described in the aforementioned patents, the play is believed to be too simplistic to hold players' attention for more than one game, while in others the instructions or scoring involved to play the games are considered too complex to attract sufficient interest to become popular.

SUMMARY OF THE PRESENT INVENTION

It is an object of the present invention to improve on games presently available to provide a board game simulating sporting events capable of maintaining player interest while at the same time is simple to play and score.

In this invention there is provided a board game involving the simulation of a variety of track and field events played in sequence which is calculated to generate competitive interest during the course of play and yet involves rules of play so simple that they can be listed briefly on the inside surface of the box containing the game parts.

The preferred embodiment of this invention comprises a game board displaying a track for running events and displays for pole vault, broad jump, high jump, and a shot put, for a total of twelve separate sports activities divided into groups of inside, short distance, and long distance events. In addition to the board there is provided a pair of dice, five teams (each team represented by a player of the game), each team having twelve competitors or participants, one for each event except that in the relay race four competitors are required, and a winners circle.

Inside events are played first, followed by short distance events, and then the long distance events. The throwing of the dice establishes the order of the players for each event. Scoring for each event depends on whether it is an inside, short distance, or long distance event. The winner of each event is moved into the winners circle. When all the events are completed, the team (that is, the player) with the most playing pieces in the winners circle is the winner of the game.

The objects and advantages of this invention as described above as well as other objects and advantages of this invention will become obvious from the following description of the preferred embodiment of this invention.

DESCRIPTION OF THE PREFERRED EMBODIMENT

Figure 1:
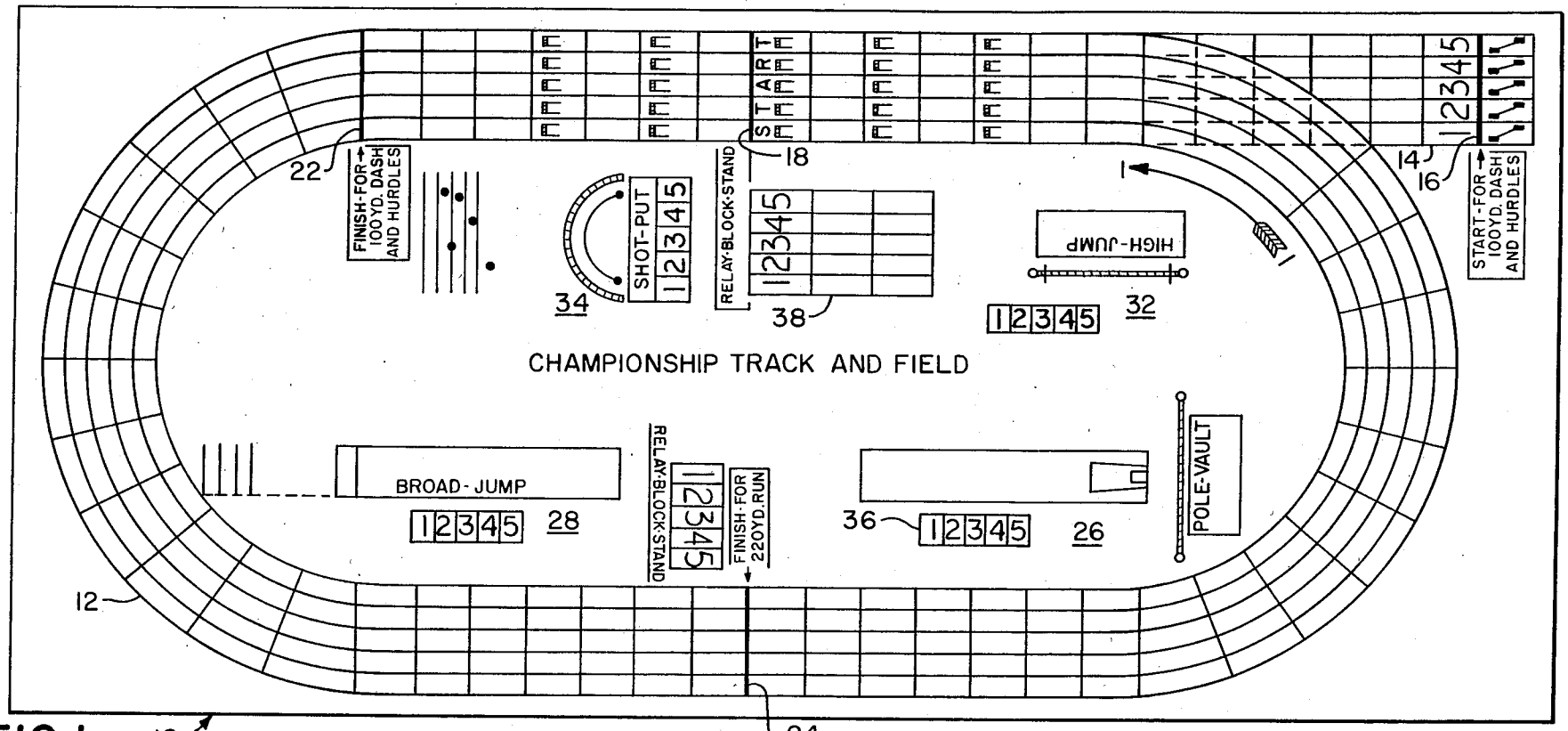
FIG. 1 is a top plan view of the game board in accordance with a preferred embodiment of this invention.

Referring to FIG. 1, game board 10 depicts the various sporting events to be played in accordance with the playing rules of this game. The number of players required for this game is two to five.

On game board 10 is shown a running track 12 with five lanes for five players, each player representing a team of participants for the twelve events. Track 12 is generally oval in configuration with a pair of straight sides conforming generally to tracks now in use for such competition. Track 12 has an extended section 14 for the starting line 16 in the 100 yard and hurdles races, and starting line 18 for races without other designated starting lines. In addition, finish line 22 is provided for the 100 yard dash and hurdles race, while finish line 24 is for the 220 yard run. In track 12, one full lap is one quarter mile, or 440 yards.

Within the region encompassed by track 12 are located the various areas designated for the inside events, namely, area 26 for pole vault, area 28 for broad jump, area 32 for high jump, and area 34 for the shot put. Each of the above areas have designated spots for the placement of the teams' participants, that is, a board piece for each player, as, for example, block stand 36 for pole vault. The purpose of relay blockstand 38 with room for three board pieces for each player will be described later. The numbers one through five in each block stand indicate the order of play which is determined in a manner to be described below.

Figure 3:
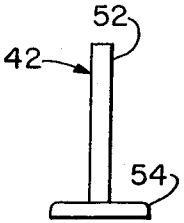
FIG. 3 is a side view of one of the game board pieces.
Figure 2:
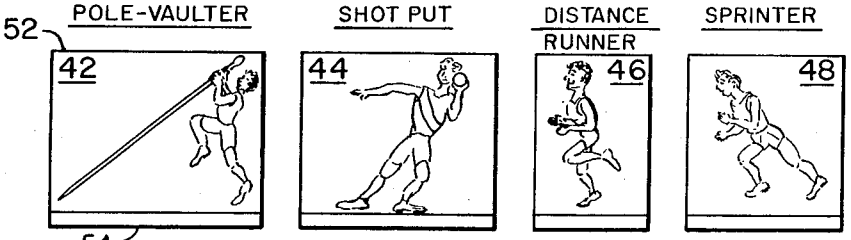
FIG. 2 is an elevation view of several board pieces which are placed on and moved about the game board shown in FIG. 1.

Referring to FIG. 2, board pieces 42, 44, 46, and 48 are illustrated showing a pole vaulter, shot-putter, distance runner, and sprinter. Each piece, such as described for the pole vaulter, consists of a rectangular piece 52 of suitable material such as cardboard inserted in a pedestal 54, as also shown in FIG. 3. Cardboard 52 has the drawing of the pole vaulter on both sides and when inserted into a slot in pedestal 54, which could be constructed from any suitable material such as wood or plastic, can be moved around readily on board 10. There is at least one set of board pieces in a color for each team, with a different color for each of the five teams (i.e., red, yellow, blue, green, and black), representing a player of the game. In practice it may be desirable to have multiple board pieces in the same color since there are twelve events, and as will be seen below, the same board piece is used in different events and in each event a board piece representing the winning team will be moved into the winners circle to be described below.

Figure 4:
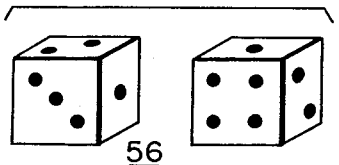
FIG. 4 shows a pair of dice.

As seen in FIG. 4, a pair of dice 56 are employed to move the board pieces in each event.

Figure 5:
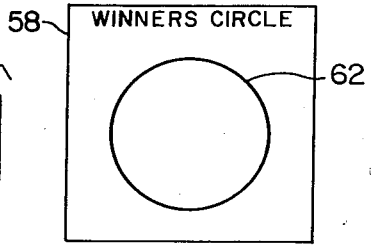
FIG. 5 is a top plan view of separate board on which is located the winners circle.

Referring to FIG. 5, a small board 58 with a winners circle 62 is provided to collect the winners from the various events.

The following chart sums up the various events to be conducted in accordance with the principles of this invention:

| Event No. | Event |
|---|---|
| INSIDE EVENTS (Played with Both Dice) | |
| 1. | Pole Vault |
| 2. | Broad Jump |
| 3. | High Jump |
| 4. | Shot Put |
| SHORT DISTANCE EVENTS (Played with One Die) | |
| 5. | 100 Yard Dash |
| 6. | Hurdles |
| 7. | 220 Yard Run |
| LONG DISTANCE EVENTS (Played with Both Dice) | |
| 8. | 440 Yard Run (1 lap around) |
| 9. | 880 Yard Run (2 laps around) |
| 10. | 1 Mile Run (4 laps around) |
| 11. | 2 Mile Run (8 laps around) - Optional |
| 12. | Relay Race (4 players needed from each team) |

In carrying out the play of the game covered by this invention, the object is to accumulate in winners circle 62 as many board pieces as possible as all of the events are conducted in sequence. The player with the most winners in circle 62 is the track and field champion for the game which has just been completed.

The rules of play for the various events are as follows:

To determine who goes first for each event, each player throws the dice. The player with the highest total starts the play first event. In case of a tie, the dice are thrown by the winners and the player with the higher total goes next. The player with the next highest total is second, and this order continues down to the player who had the lowest total. The order of play is determined as described above for each event, and the board pieces for the players in each event are placed on the block stand in the order of play as determined by the dice throws.

Inside Events

All inside events are played first. The board pieces for each event are placed in the appropriate block stand on the board. Each player throws the dice three times. The highest number appearing out of the three thrown represents how many feet that player has vaulted, jumped, or shot putted. The winner of each event is placed in winners circle 62 so that when the inside events are concluded there should be four board pieces in circle 62.

Short Distance Events

In these events, only one die is thrown. For each event the board piece from the player's team is placed at the appropriate starting line indicated by the number on the lane as to the order of play as determined by the dice throws. Starting line 18 is employed for the 220 yard run, and starting line 16 for the 100 yard dash and the hurdles. Finish lines are 22 and 24, respectively.

Each player rolls the die in turn, moving his board piece according to the number which appears face up on the die. The player whose piece crosses the finish line first is the winner of that event and the winning board piece is moved to winners circle 62. At the end of the short distance events there should be seven board pieces in circle 62.

Long Distance Events

In each of these events both dice are employed. The starting line for all these events is line 18, and since each of these events involves full laps, starting line 18 functions also as the finish line. The players roll the dice in turn for each event, and if a double appears, the player has another throw. As long as the player continues to throw doubles he continues to play. Each player's board piece is moved down the lane in accordance with the number thrown, and the first piece to cross over the finish line is the winner of that event.

In the relay race, four players are required for play, so that the three not in play at any one time are placed in relay block stand 38 on the board. Beginning at starting line 18, the first piece moves through one lap (440 yards), and hands off to the second piece which places the first piece on the track. The second piece is moved through one half lap (a 220 yard run) and hands off to the third piece which runs another ½ lap, followed by the fourth piece which is moved along for an 880 yard run (2 laps). The player with the winning relay team places all four relay players in winners circle 62. In events 9 through 12, any players lapped, that is, passed by another over the course, are automatically out of that event. As previously indicated the two mile run is optional and may be eliminated if it is decided to shorten the time required to play the game.

The winning player is the one whose team has the most board pieces in the winners circle.

As only four different board pieces are illustrated, it is apparent that each type of piece must be used in a variety of events. Also, as board pieces do accumulate on board 58 and effectively become out of play, the game may provide a sufficient number of extra pieces in each color to assure a sufficient number of pieces for all possible contingencies, or in the alternative, in the event it is necessary to withdraw a board piece from board 58 for use in play on board 10, a notation to that effect can be made so that a running account of the winners of the events played can be maintained. However, it is readily apparent that by providing a sufficient number of extra board pieces for each team, it is possible to keep score without the use of pencils, crayons, pens, chalk, etc., which is an important feature of this invention.

It will be noted from the foregoing description of the preferred embodiment of this invention that there is provided a game which realistically simulates the participation of competitors in the described events without resorting to complex rules of play nor the reliance on any scorekeeping system which would tend to detract from the excitement which develops during the course of play.

While only the preferred embodiment of this invention has been described, it is understood that many variations thereof are possible without departing from the principles of this invention as set forth in the claims which follow.

What is claimed is:

1. A game of championship track and field events for simulated competition among a plurality of teams, each team representing a player comprising:

a playing board having a generally oval track with straight sides along its long side wherein are marked lanes for a plurality of runners, one full lap in said track representing the distance of 440 yards, having a single starting and finish line for all distances which are a multiple of the distance around said track including a relay race, separate starting and finish lines for the 100 yard dash and a hurdles race, with hurdles indicated in said lane, and a separate finish line for a 220 yard run, said playing board being provided with a block stand adjacent said oval track containing spaces designated for each relay team;

separated designated areas on said playing board surrounded by said track, said areas consisting of a pole vaulting area, a broad jump area, a high jump area, and a shop put area, each separate area being provided with a block stand containing spaces designated for each team;

a plurality of board pieces comprising a separate group of pieces designated for each team consisting of at least four board pieces, each team color differentiated from each other team and furthermore each piece of each team further differentiated from each other to designate a particular event;

a pair of dice to be thrown by each player to establish the order of play and for moving the board pieces in each event; and separate board means containing a winners circle adapted to accumulate and accomodate the winning board pieces from each event, said separate board means being capable of accommodating at least said at least four board pieces, the winning team being the team having the most board pieces accumulated in said winners circle on said separate board means after the play of all events is completed.

2. The game of claim 1 in which said track on said playing board is provided with offshoot lanes for the starting line of the 100 yard dash and the hurdles races.

3. The game of claim 2 wherein the block stand surrounded by said track provided for the board pieces participating in said relay race contains sufficient spaces for all the runners in said relay race thereby permitting handing off from one game piece to another as the relay race proceeds.

4. The game of claim 3 in which said track accommodates the short distance events, 100 yard dash, hurdles, and 220 yard run.

5. The game of claim 4 in which said lanes in said track and the spaces in each block stand are numbered to correspond with the number of teams which can play the game and designate the order of play for each event as determined by throws of said dice.

* * * * *